US005248578A

United States Patent [19]

Takaoka et al.

[11] Patent Number: 5,248,578

[45] Date of Patent: Sep. 28, 1993

[54] ELECTROPHOTOGRAPHIC PHOTORECEPTOR HAVING EPOXY COMPOUNDS IN THE CHARGE GENERATOR LAYER

[75] Inventors: Kazuchiyo Takaoka; Hideya Arisue, both of Tsukuba, Japan

[73] Assignee: Mitsubishi Paper Mills Limited, Tokyo, Japan

[21] Appl. No.: 805,497

[22] Filed: Dec. 12, 1991

Related U.S. Application Data

[63] Continuation-in-part of Ser. No. 578,615, Sep. 7, 1990, abandoned.

[30] Foreign Application Priority Data

Sep. 7, 1989 [JP] Japan ..... 1-232328
Sep. 7, 1989 [JP] Japan ..... 1-232329
Aug. 20, 1990 [JP] Japan ..... 2-219160

[51] Int. Cl.[5] ..... G03G 5/14
[52] U.S. Cl. ..... 430/58; 430/64; 430/96
[58] Field of Search ..... 430/58, 64, 96, 49

[56] References Cited

U.S. PATENT DOCUMENTS 4,439,507 3/1984 Pan et al. ..... 430/58
4,933,244 6/1990 Teuscher et al. ..... 430/58

FOREIGN PATENT DOCUMENTS 2905477 9/1979 Fed. Rep. of Germany .

OTHER PUBLICATIONS

English translation of the Office Action dated Nov. 15, 1991 issued by German Patent Office in Counterpart.

*Primary Examiner*—Marion E. McCamish
*Assistant Examiner*—S. Rosasco
*Attorney, Agent, or Firm*—Cushman, Darby & Cushman

[57] ABSTRACT

The invention relates to a double-layered electrophotographic photoreceptor comprising a conductive support, a carrier generation layer provided on the conductive support, and a carrier transport layer provided on the carrier generation layer. The carrier generation layer contains a generation material, which generates carrier upon absorption of light, and a compound having an epoxy group. The carrier transport layer contains a carrier transport material which transports the generated carrier. This photoreceptor has excellent pre-exposure properties and durability for repeated use.

7 Claims, No Drawings

ELECTROPHOTOGRAPHIC PHOTORECEPTOR HAVING EPOXY COMPOUNDS IN THE CHARGE GENERATOR LAYER

This is a continuation-in-part of Ser. No. 07/578,615 filed Sep. 7, 1990, now abandoned.

BACKGROUND OF THE INVENTION

1. Field of the Invention

The present invention relates to an electro-photographic photoreceptor excellent for repeated use.

2. Description of the Related Art

Known electrophotographic photoreceptors having a photosensitive layer composed of inorganic photoconductive compounds, such as selenium, zinc oxide and cadmium sulfide, have been made.

However, these are not satisfactory in sensitivity, heat stability, moisture resistance and endurance. Selenium and cadmium sulfide, in particular, have a limited use in production and handling because of their toxicity.

Known electrophotographic photoreceptors having a photosensitive layer composed of organic photoconductive compounds have been made. These photoreceptors have many merits in that they are relatively easy to produce and handle, are inexpensive and generally superior to selenium photoreceptors in heat stability.

Poly-N-vinylcarbazole is a well known organic photoconductive compound. An electrophotographic photoreceptor having a photosensitive layer composed of a charge transfer complex formed from poly-N-vinylcarbazole and a Lewis acid such as 2,4,7-trinitro-9-fluorenone is disclosed in Japanese Patent Kokoku No. 50-10496. However, this photoreceptor is not satisfactory in sensitivity, film formability and endurance.

Organic photoconductors of low molecular weight represented by hydrazone and pyrazolines have been tried. Film-formability is considerably improved by combining these organic photoconductors with suitable binders. However, the improvement in sensitivity and endurance is insufficient to warrant their use.

Recently, a double-layered type photoreceptor in which a carrier generating function and a carrier transporting function are born on separate substances, has been proposed. Employing this structure has resulted in remarkable improvements in charging characteristics and sensitivity. Photoreceptors having a sensitivity near that of inorganic photoreceptors, such as Se, can be made by combining a carrier generation layer comprising an azo pigment, which has a high carrier generating ability, with a carrier transport layer containing a hydrazone type carrier transport material, which has a high carrier transporting ability. As a result, photoreceptors composed of organic photoconductive compounds of these types are now being used in copy machines and printers. However, electro-photographic photoreceptors made of these organic materials are not stable when used repeatedly in a copy machine. After repeated use, the initial potential decreases and the residual potential after removal of charge increases.

SUMMARY OF THE INVENTION

The object of the present invention is to provide an electrophotographic photoreceptor which does not undergo a change in properties after repeated use in an electro-photographic process.

The present invention is a double-layered type electrophotographic photoreceptor which comprises a conductive support, a carrier generation layer provided on the conductive support and a carrier transport layer provided on the carrier generation layer. The carrier generation layer contains a carrier generation material which generates carrier upon absorption of light. The carrier transport layer contains a carrier transport material which transports the generated carrier. The carrier generation material contains at least one compound which has an epoxy group.

DETAILED DESCRIPTION OF THE PREFERRED

Examples of compounds having an epoxy group for use in the carrier generation material are as follows. The present invention is not limited to these examples.

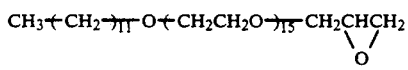

(I-1)

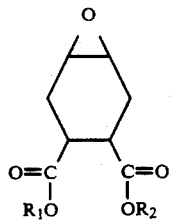

($R_1$ and $R_2$ each represents an alkyl group of 1-12 carbon atoms, such as methyl, ethyl, propyl, butyl, 2-ethglhexyl and lauryl).

(I-2)

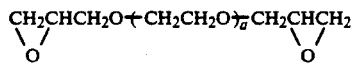

(a represent an integer of 1-22.)

(I-3)

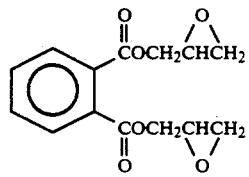

(I-4)

-continued
(I-5)
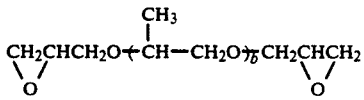
(b represents an integer of 1–11.)
(I-6)
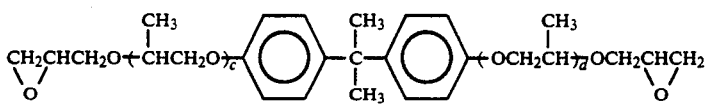
(c and d each represents an integer of 1–4.)
(I-7)
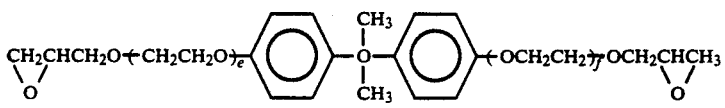
(e and f each represents an integer of 2–4.)
(I-8)
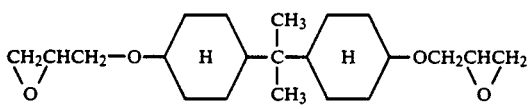
(I-9)
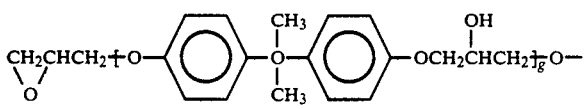
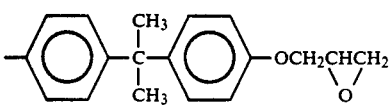
(g represents an integer of 1–20.)
(I-10)
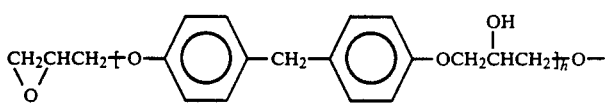
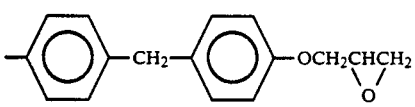
(h represents an integer of 1–10.)
(I-11)
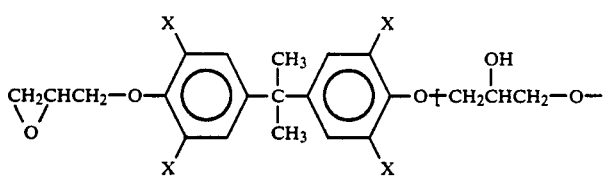
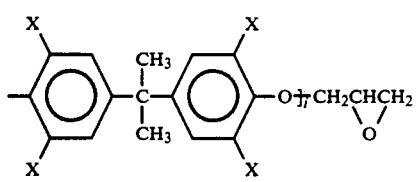
(X represents a halogen atom and i represents an integer of 1–4.)
(I-12)
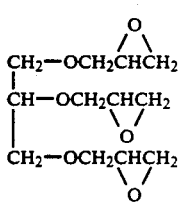

-continued (I-13)

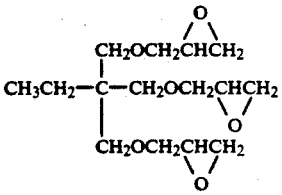

(I-14)

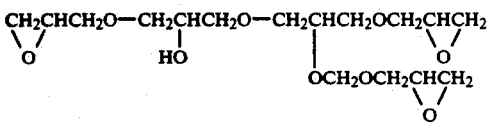

(I-15)

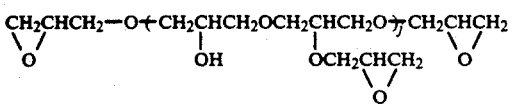

(j represents 2 or 3.)

(I-16)

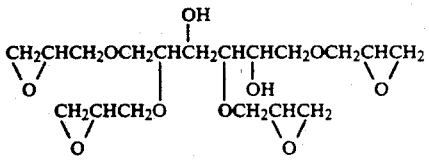

(I-17)

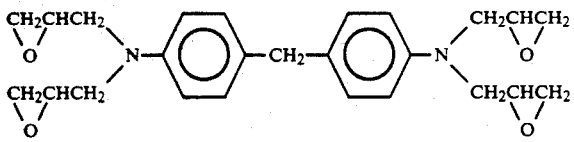

(I-18)

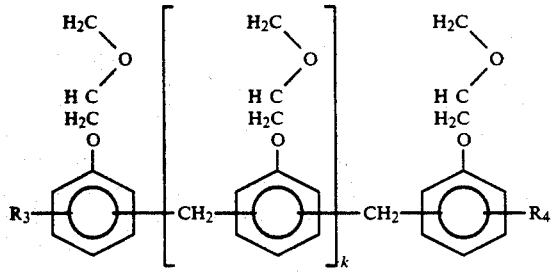

($R_3$ and $R_4$ each represents a hydrogen atom or an alkyl group of 1–4 carbon atoms and K represents an integer of 0–15.)

Furthermore, polymers having epoxy groups can also be obtained by synthesizing polymers using, for example, the following compound (I-19).

(I-19)

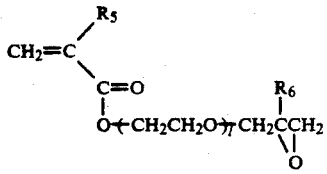

($R_5$ and $R_6$ each represents a hydrogen atom or an alkyl group of 1–4 carbon atoms and l represents 0, 1 or 2.)

Examples of the polymers obtained are shown below. The molecular weight of these polymers is preferably $0.5\times10^4$–$10\times10^4$.

(I-20)

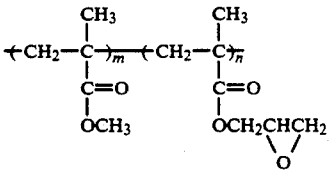

($m + n = 1$, and $1 \geqq n > 0.1$)

(I-21)

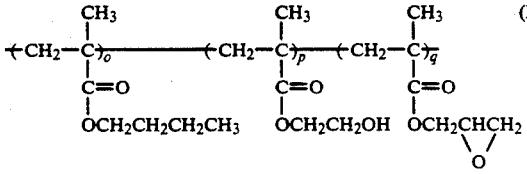

($o + p + q = 1$, $0.9 \geqq q > 0.1$, $o \geqq 0.05$ and $p \geqq 0.05$)

-continued

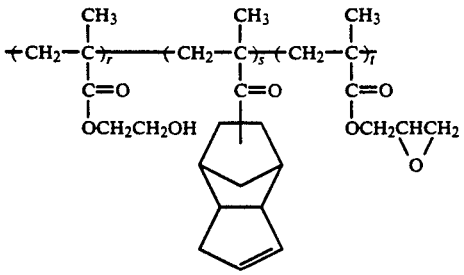

(I-22)

(r + s + t = 1, t ≧ 1.0, r ≧ 0.05, and t ≧ 0.05)

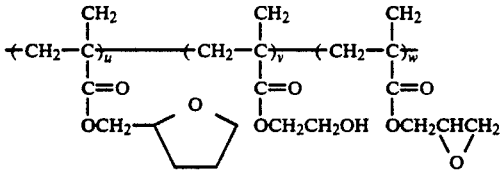

(I-23)

(u + v + w = 1, w ≧ 0.1, u ≧ 0.05, and v ≧ 0.05)

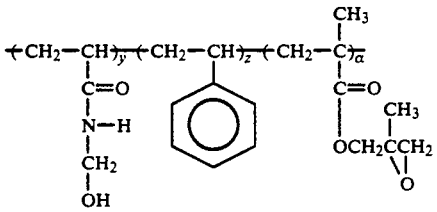

(I-24)

(y + z + α = 1, α ≧ 0.1, y ≧ 0.02, and z ≧ 0.02)

Among the above compounds, preferred are I-6, I-7, I-12, I-16, I-18, and I-21 and especially preferred are those which are represented by the following formulas.

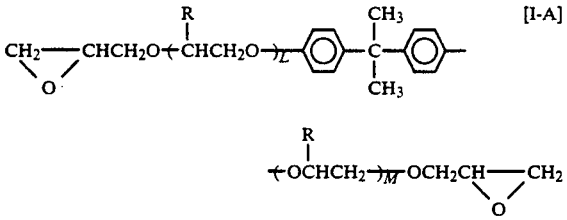

[I-A]

wherein R represents a hydrogen atom or an alkyl group of 1–4 carbon atoms, L and M each represents an integer of 1–4, and the above-exemplified compounds I-6 and I-7 are included in this formula.

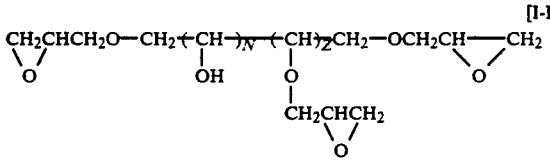

[I-B]

wherein N+Z represents an integer of 1–4 and the compounds I-12 and I-16 are included therein.

The elements of the present invention are explained below in detail.

First, conductive supports that can be utilized in the present invention include those employed in known electrophotographic photoreceptors.

Examples of conductive supports include drums and sheets of metals such as aluminum and copper, laminates of foils of these metals and sheets having vapor-deposits of these metals.

Further examples of conductive supports include plastic films, plastic drums and sheets of paper which are subjected to a conductive treatment by coating with conductive substances such as metal powder, carbon black, carbon filter, copper iodide, or polymeric electrolytes together with suitable binders.

Second, a carrier generation layer is formed on the conductive support by coating the conductive support with a dispersion containing a solvent, a pigment or dye as a carrier generation material, and the above-mentioned epoxy compound. If necessary, other resin can be added as a binder and coating for the dispersion.

Examples of binders for the carrier generation layer include conventionally known polymers and copolymers of vinyl compounds such as styrene, vinyl acetate, acrylic esters, and methacrylic esters, phenoxy resin, butyral resin, formal resin, urethane resin, phenolic resin, and polyester resin, but these are not critical.

Examples of pigments include, azo pigments represented by monoazo pigments, polyazolone azo pigments, metal complex azo pigments, stilbene pigments, and thiazole azo pigments, perylene pigments such as perylenic anhydride and perylenic acid imide, anthraquinone or polycyclic quinone pigments represented by anthraquinone derivatives, anthanthrone derivatives, dibenzopyrene-quinone derivatives, pyranthrone derivatives, violanthrone derivatives, and isoviolanthrone derivatives, and phthalo-cyanine pigments represented by metallo-phpthalocyanine, metallo-napthalocyanine, metal-free phthalocyanine and metal-free naphthalocyanine.

Examples of dyes include triphenylmethane dyes represented by Methyl Violet, quinone dyes such as quinizarine, pyrylium salts, thiapyrylium salts and benzopyrylium salts.

The compound containing epoxy group is used in an amount of about 0.1–1000 parts by weight, preferably about 1–400 parts by weight per 100 parts by weight of carrier generation material.

When other resin is used as a binder, the binder resin is used in an amount of about 1–1000 parts by weight, preferably about 10–200 parts by weight per 100 parts by weight of carrier generation material. The thickness of the carrier generation layer is preferably about 0.1–2 μm.

Examples of the solvent include ethers such as 1,2-dimethoxyethane, tetrahydrofuran, and 1,4-dioxane; ketones such as methyl ethyl ketone and cyclohexanone; aromatic hydrocarbons such as toluene and xylene; aprotic polar solvents such as N,N-dimethylformamide, acetonitrile, N-methylpyrrolidone, and dimethyl sulfoxide; alcohols such as methanol, ethanol and isopropanol; esters such as ethyl acetate, methyl acetate and methyl cellosolve acetate; and chlorinated hydrocarbons such as dichloroethane and chloroform.

Third, a carrier transport layer is formed on the carrier generation layer by coating the carrier transport layer with a dispersion containing a solvent, a binder and a carrier transport material.

The carrier transport material is used in an amount of 20–500 parts by weight, preferably 50–200 parts by weight when amount of binder is 100 parts by weight.

Examples of the binder include polymers and copolymers of vinyl compounds such as styrene, vinyl chloride, acrylic esters, methacrylic esters and vinyl acetate, phenoxy resin, polysulfone, polycarbonate, polyarylate, polyester, cellulose ester, cellulose ether, urethane resin, epoxy resin, and silicone resin.

Examples of the solvent include tetrahydrofuran, methyl ethyl ketone, benzene, toluene, monochlorobenzene, 1,2-dichloroethane, methylene chloride and ethyl acetate.

Examples of carrier transport materials are shown below, but the present invention is not limited thereto.

(Me = Methyl, Et = Ethyl)

(II-1)

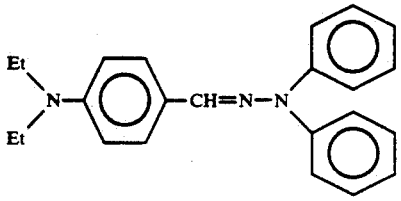

(II-2)

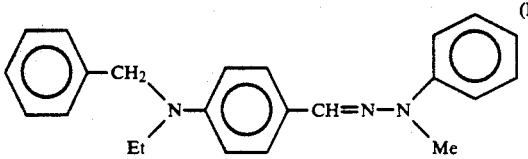

(II-3)

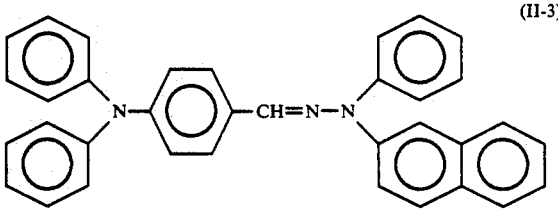

(II-4)

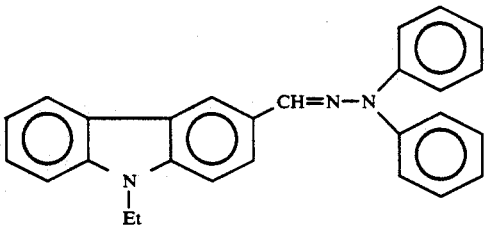

(II-5)

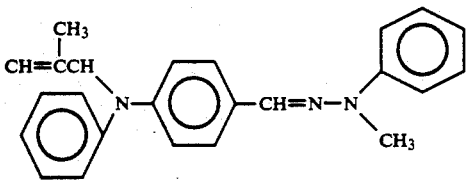

(II-6)

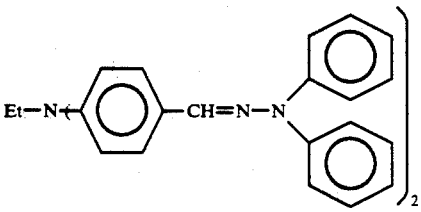

-continued (II-7)

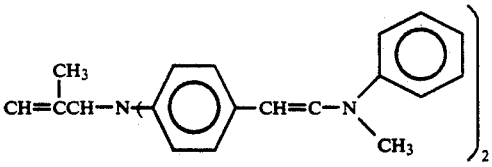

(II-8)

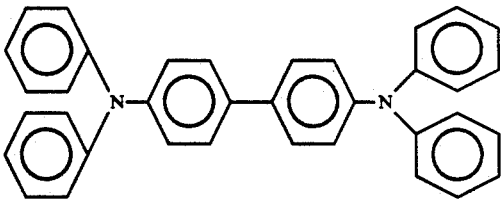

(II-9)

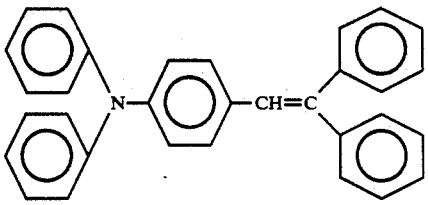

(II-10)

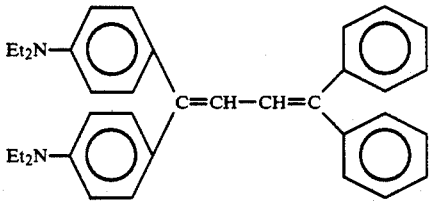

Thickness of the carrier transport layer is preferably about 5–100 μm.

A photosensitive layer contains at least the carrier generation layer and the carrier transport layer. If necessary, the photosensitive layer may contain an adhesive layer, an interlayer, a transparent insulating layer, a surface protective layer, or the like.

The photosensitive layer may also contain, for example, known plasticizers to improve film-formability, flexibility and mechanical strength. Examples of plasticizers include phthalic esters, phosphoric esters, chlorinated paraffins, chlorinated fatty acid esters and aromatic compounds such as methylnaphthalene.

The photosensitive layer may further contain additives such as antioxidant for improvement of electrophotographic characteristics.

The present invention is further explained by the following examples. The present invention is in no way limited by these examples.

EXAMPLE 1

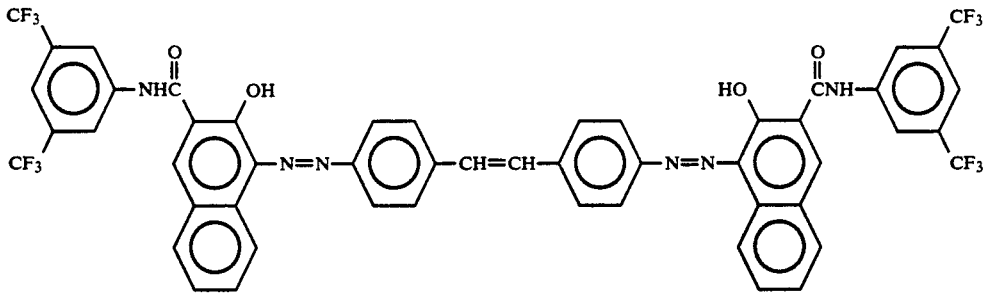

0.2 g of azo compound having the above structure, 0.2 g of epoxy compound of the exemplified compound I-6 (c and d are 3 and 4, respectively) (RIKARESIN BPO-20E manufactured by Shin Nihon Rika Co.) were added to 20 ml of tetrahydrofuran and dispersed for 2 hours by a paint shaker. The resulting dispersion was coated on an aluminum-vapor deposited conductive PET film support (METAEKY manufactured by Panak Kogyo Co.) and then dried to a thickness of 0.2 μm to form a carrier generation layer.

Furthermore, 2.0 g of the above-exemplified hydrazone compound (II-2) and 2.0 g of polyarylate resin (U-100 manufactured by Unitika, Ltd.) were dissolved in 20 g of methylene chloride and the solution was coated on the carrier generation layer at a dry thickness of 20 pm to form a carrier transport layer. An electrophotographic photoreceptor was thereby obtained.

This photoreceptor was kept in the dark at room temperature for one day and thereafter subjected to measurement of quantity of charge at a charging voltage of −4.8 KV using an electrostatic paper testing apparatus SP-428 manufactured by Kawaguchi Denki Seisakusho Co. The Surface of the photosensitive layer was then illuminated with light by a fluorescent lamp of 5000 lux for 5 minutes and subjected to measurement of quantity of charge under the same charging conditions and percent of ratio of quantities of charge before and after illumination of light. This measurement is the pre-exposure characteristic.

Changes in initial potential and residual potential after repetition of 10,000 times of the above process were measured separately by tracing the surface potential with a surface electrometer 344 (manufactured by Treck Co.) in a copying machine SF-8100 (manufactured by Sharp Corporation) from which the developing part was removed. The initial potential herein used is a surface potential of the photoreceptor when light has not been illuminated thereon and is about 750–650 V. The residual potential is a residual surface potential of the photoreceptor after the surface potential has been removed by illumination of light for removal of the charge.

The results are shown in Table 1.

COMPARATIVE EXAMPLE 1

0.2 g of the same ozo compound as used in Example 1 and 0.2 9 of phenoxy resin (PKHJ manufactured by Union Corbicle Corporation (UCC)) were added to 20 ml of tetrahydrofuran and dispersed for 2 hours by a paint shaker. In the same manner as in Example 1, a carrier generation layer and a carrier transport layer were formed to make an electrophotographic photoreceptor. The preexposure characteristics and the change in potential due to repetition of the process were measured and the results are shown in Table 1.

COMPARATIVE EXAMPLE 2

An electrophotographic photoreceptor was produced in the same manner as in Example 1 except that polyester resin v 200 (manufactured by Toyobo CO., Ltd.) was used as a binder for the carrier generation layer. The characteristics thereof were measured and the results are shown in Table 1.

TABLE 1

| | Pre-exposure characteristic (Change in initial potential by illumination of 5000 lux for 5 minutes)*1 (%) | Change in potential after repetition of 10,000 times (V) | |
|---|---|---|---|
| | | Initial potential | Residual potential |
| Example 1 | 75 | −20 | +53 |
| Comparative Example 1 | 65 | −80 | +67 |
| Comparative Example 2 | 60 | −95 | +75 |

*1 $\frac{\text{Initial potential after illumination of light}}{\text{Initial potential before illumination of light}} \times 100$

EXAMPLE 2

A photoreceptor was produced in the same manner as in Example 1 except that hydrazone compound (II-5) was used in place of compound (II-2). The characteristics thereof were measured and the results are shown in Table 2.

COMPARATIVE EXAMPLE 3

A photoreceptor was produced in the same manner as in Example 1 except that the binder for the carrier generation layer as used in Comparative Example 1 (phenoxy resin PKHJ) and the hydrazone compound as used in Example 2 (II-5) were utilized. The characteristics of the photoreceptor were measured and the results are shown in Table 2.

COMPARATIVE EXAMPLE 4

A photoreceptor was produced in the same manner as in Example 1 except that the binder for carrier generation layer as used in Comparative Example 2 (polyester resin VIRON 200 manufactured by Toyobo Co., Ltd.) and the hydrazone compound (II-5) as used in Example 2 were utilized. The characteristics of the photoreceptor were measured and the results are shown in Table 2.

TABLE 2

| | Pre-exposure characteristic (Change in initial potential by illumination of 5000 lux for 5 minutes)*1 (%) | Change in potential after repetition of 10,000 times (V) | |
|---|---|---|---|
| | | Initial potential | Residual potential |
| Example 2 | 82 | −15 | +40 |
| Comparative Example 3 | 75 | −78 | +57 |
| Comparative Example 4 | 74 | −85 | +65 |

*1Same as in Table 1

TABLE 3-continued

| | Pre-exposure characteristic (Change in initial potential by illumination of 5000 lux for 5 minutes)*1 (%) | Change in potential after repetition of 10,000 times (V) | |
|---|---|---|---|
| | | Initial potential | Residual potential |
| Comparative Example 1 | 65 | −80 | +67 |

*1Same as in Table 1

EXAMPLE 6

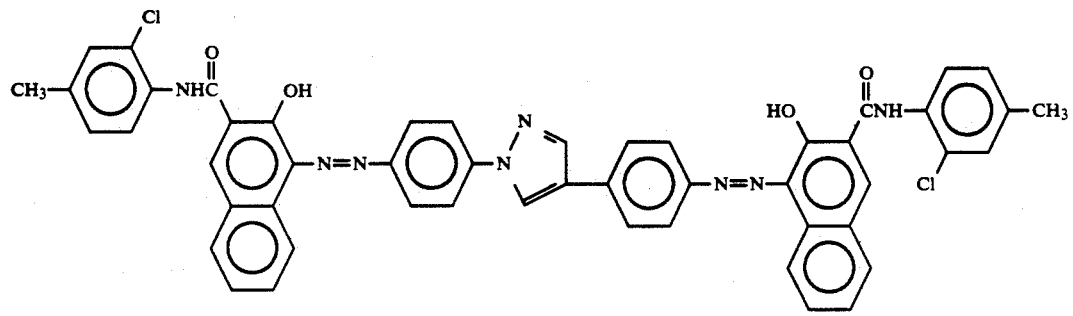

EXAMPLE 3

0.2 g of the same azo compound as used in Example 1, 0.15 g of the epoxy resin (RIKARESIN BPO-20E), and 0.05 g of phenoxy resin (PKHJ manufactured by UCC) were added to 20 ml of 1,2-dimethoxyethane and were dispersed by a paint shaker for 2 hours. In the same manner as in Example 1, the resulting dispersion was utilized to make a photoreceptor. The characteristics were measured and the results are shown in Table 3.

EXAMPLE 4

0.2 g of the same azo compound as used in Example 1, 0.1 g of the epoxy resin (RIKARESIN BPO-20E), and 0.1 g of phenoxy resin (PKHJ) were added to 20 ml of 1,2-dimethoxyethane and were dispersed by a paint shaker for 2 hours. In the same manner as in Example 1, the resulting dispersion was utilized to make a photoreceptor. The characteristics were measured and the results are shown in Table 3.

EXAMPLE 5

0.2 g of the same azo compound as used in Example 1, 0.05 g of the epoxy resin (BPO-20E), and 0.15 g of phenoxy resin (PKHJ) were added to 20 ml of 1,2-dimethoxyethane and were dispersed by a paint shaker for 2 hours. In the same manner as in Example 1, the resulting dispersion was utilized to make a photoreceptor. The characteristics were measured and the results are shown in Table 3.

TABLE 3

| | Pre-exposure characteristic (Change in initial potential by illumination of 5000 lux for 5 minutes)*1 (%) | Change in potential after repetition of 10,000 times (V) | |
|---|---|---|---|
| | | Initial potential | Residual potential |
| Example 1 | 75 | −20 | +53 |
| Example 3 | 74 | −28 | +48 |
| Example 4 | 70 | −45 | +52 |
| Example 5 | 67 | −57 | +58 |

0.2 g of azo compound having the above structural formula, 0.2 g of novolak type epoxy resin (YDCN manufactured by Toto Kasei Co.) were added to 20 ml of 1,2-diemthoxyethane and dispersed for 2 hours by a paint shaker. The resulting dispersion was coated on an aluminum-vapor deposited PET film support (METALMY manufactured by Panak Kogyo Co.) and then dried to a thickness of 0.2 μm to form a carrier generation layer.

Furthermore, 2.0 g of the above-exemplified hydrazone compound (II-2) and 2.0 g of polyarylate resin (U-100 manufactured by Unitika, Ltd.) were dissolved in 20 g of methylene chloride and the solution was coated on the carrier generation layer to form a carrier transport layer at a dry thickness of 20 μm. An electrophotographic photoreceptor was thereby produced.

This photoreceptor was kept in the dark at room temperature for one day and then subjected to measurement of quantity of charge at a charging voltage of −4.8 KV using an electrostatic paper testing apparatus SP-428 manufactured by Kawaguchi Denki Seisakusho Co. The surface of the photosensitive layer was then illuminated with light by a fluorescent lamp of 5000 lux for 5 minutes and was again subjected to measurement of quantity of charge under the same charging conditions and percent of ratio of quantities of charge before and after illumination of light. This is the preexposure characteristic.

Changes in initial potential and residual potential after repeated use of 10,000 times were measured separately by tracing the surface potential with a surface electrometer 344 (manufactured by Treck Co.) in the copying machine SF-8100 (manufactured by Sharp Corporation) from which the developing part was removed.

The results are shown in Table 4.

EXAMPLE 7

An electrophotographic photoreceptor was produced in the same manner as in Example 6 except that novolak type epoxy resin (YDPN manufactured by Toto Kasei Co.) was used as a binder for the carrier generation layer. The characteristics thereof were measured and the results are shown in Table 4.

COMPARATIVE EXAMPLES 5, 6 AND 7

Electrophotographic photoreceptors were produced in the same manner as in Example 6 except that as a binder for carrier generation layer, phenoxy resin (PKHJ) was used in Comparative Example 5, polyester resin (VIRON 200) was used in Comparative Example 6, and butyral resin (#15000-A manufactured by Denka Co., Ltd.) was used in Comparative Example 7. The characteristics of each example were measured and the results are shown in Table 4.

TABLE 4

| | Resin used for carrier generation layer | | Pre-exposure characteristic (Ratio of initial potentials before and after illumination of light of 5000 lux for 5 minutes) (%)*1 | Change in potential after repetition of 10000 times (V) | |
|---|---|---|---|---|---|
| | | | | Initial potential | Residual potential |
| Example 6 | YDCN | Novolak type resin | 80 | −8 | +48 |
| Example 7 | YDPN | Novolak type resin | 82 | −12 | +43 |
| Comparative Example 5 | PKHJ | Phenoxy resin | 65 | −35 | +55 |
| Comparative Example 6 | V-200 | Polyester resin | 60 | −40 | +63 |
| Comparative Example 7 | #5000-A | Butyral resin | 58 | −42 | +83 |

*1Same as in Table 1

EXAMPLE 8

0.2 g of an azo compound having the following structural formula and 0.2 g of the above-exemplified compound (I-6) (c and d were 3 and 4, respectively) (RIKARESIN BPO-20E) were added to 20 cc of 1,2-dimethoxy-ethane and dispersed together with glass beads by a paint shaker for 4 hours to obtain a pigment dispersion.

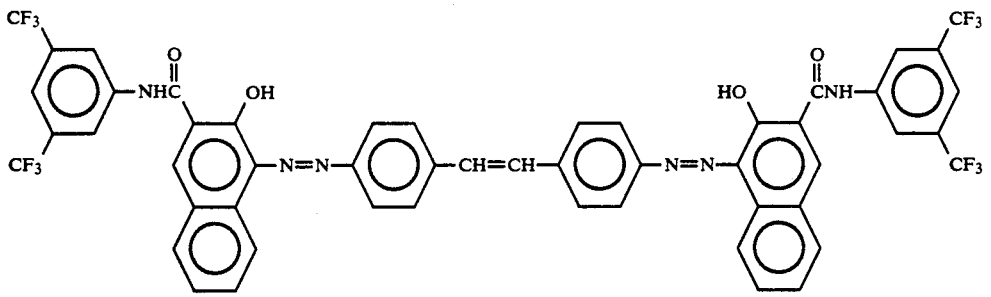

The resulting dispersion was coated on an aluminum foil (#1050 manufactured by Japan Test Panel Kogyo Co.) of 0.1 mm thick and dried at 80° C. for 15 minutes to form a carrier generation layer with a dry thickness of 0. 2 μm.

Furthermore, 2.0 g of the above-exemplified hydrazone compound (II-2), 1.0 g of polyarylate resin (U-100 manufactured by Unitika, Ltd.), a modified polycarbonate resin (Z-200 manufactured by Mistubishi Gas Chemical Co., Inc.), and 0.04 g of α-tocopherol as an additive were dissolved in 20 g of methylene chloride. The solution was coated on the carrier generation layer and dried at 80° C. for 1 hour to form a carrier transport layer of 20 μl thick. An electrophotographic photoreceptor was thereby obtained.

This photoreceptor was kept in the dark at room temperature for one day. Changes in initial potential and residual potential after repeated use of 10,000 times at room temperature were then measured by tracing the surface potential with a surface electrometer 344 (manufactured by Treck Co.) in a SF-8100 copying machine (manufactured by Sharp Corporation) from which the developing part was removed. The results are shown in Table 5.

In the following examples, production of the photoreceptor was conducted in the same manner as in Example 8.

EXAMPLE 9

0.2 g of an azo compound having the following structural formula, 0.05 g of the above-exemplified compound (I-16) (EX-614 manufactured by Nagase Kasei Co.) and 0.1 g of butyral resin (BH-3 manufactured by Sekisui Chemical Co., Ltd.) were added to 20 cc of tetrahydrofuran and dispersed by a paint shaker for 4 hours to prepare a pigment dispersion. This dispersion was coated on an aluminum foil and dried to obtain a carrier generation layer.

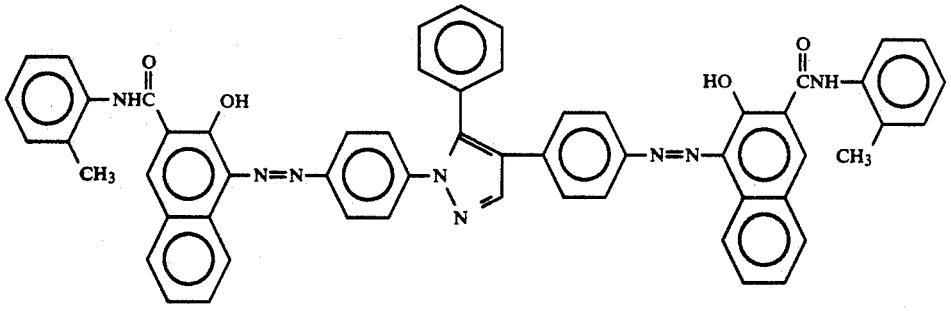

Furthermore, 2.0 g of the above-exemplified hydrazone compound (II-5), 2.0 g of polyarylate resin (U-100 manufactured by Unitika, Ltd.), and 0.01 g of n-pentadecylhydroquinone as an additive were dissolved in 20 g of methylene chloride and the solution was coated on the carrier generation layer and dried to form a carrier transport layer to obtain an electrophotographic photoreceptor. This photoreceptor was subjected to measurement in the same manner as in Example 8 and the results are shown in Table 5.

EXAMPLE 10

As the exemplified compound (I-19), 10 g of glycidyl methacrylate, 5 g of hydroxyethyl methacrylate and 85 g of n-butylmethacrylate were added to 500 cc of butyl acetate and the mixture was heated to 80° C. under bubbling with nitrogen gas. Thereto was added 1.5 g of azobisisobutyronitrile (AIBN) and heating was continued so that temperature of the solution during reaction did not exceed 100° C. After 2 hours, 0.5 g of AIBN was further added, followed by further heating for 3 hours at 80° C. Then, 40 cc of the resulting reaction mixture was diluted with 2 liters of methanol to obtain a white polymer. This polymer was dried for 24 hours at 20° C and 0.5 mmHg. This polymer was the epoxy-containing compound (1-21).

0.2 g of the azo compound used in Example 9 and 0.15 g of the resulting polymer (I-21) were added to a mixed solvent comprising 5 cc of methyl ethyl ketone and 15 cc of 1,2-dimethoxyethane and dispersed for 4 hours by a paint shaker to prepare a pigment dispersion. This dispersion was coated on an aluminum foil and dried to form a carrier generation layer.

Furthermore, 1.6 g of the exemplified hydrazone compound (II-7), 2.0 g of modified polycarbonate resin (Z-800 manufactured by Mitsubishi Gas Chemical Company, Inc.), and 0.01 g of α-tocopherol were dissolved in 20 g of methylene chloride. The solution was coated on the carrier generation layer and dried to form a carrier transport layer to make a photoreceptor. The results of measurements are shown in Table 5.

COMPARATIVE EXAMPLE 8

A photoreceptor was produced in the same manner as in Example 8 except that carrier generation layer was formed by using a dispersion prepared by adding 0.2 g of the azo compound used in Example 8 and 0.2 g of phenoxy resin (PKHJ) to 20 cc of 1,2-dimethoxyethane. The results of measurement are shown in Table 5.

COMPARATIVE EXAMPLE 9

A photoreceptor was produced in the same manner as in Comparative Example 8 except that polyester resin (VIRON 200 manufactured by Toyobo Co., Ltd.) was used in place of the phenoxy resin. Results of measurement are shown in Table 5.

COMPARATIVE EXAMPLE 10

A photoreceptor was produced in the same manner as in Comparative Example 8 except that butyral resin (#3000-K manufactured by Denki Kagaku Kogyo K.K.) was used in place of the phenoxy resin. Results of measurement are shown in Table 5.

COMPARATIVE EXAMPLE 11

A photoreceptor was produced in the same manner as in Comparative Example 8 except that dodecyl acetate was used in place of the phenoxy resin. Results of measurement are shown in Table 5.

COMPARATIVE EXAMPLE 12

0.2 g of the azo compound used in Example 9 and 0.15 g of butyral resin (BH-3 manufactured by Sekisui Chemical Co., Ltd.) were added to 20 cc of tetrahydrofuran and dispersed for 4 hours and a carrier generation layer was formed using this dispersion. Furthermore, a carrier transport layer was formed in the same manner as in Example 9. Results of measurement ate shown in Table 5.

COMPARATIVE EXAMPLE 13

A photoreceptor was produced in the same manner as in Comparative Example 12 except that modified polyarylate resin (Z-200) was used in place of the butyral resin. Results of measurement are shown in Table 5.

COMPARATIVE EXAMPLE 14

A polymer was obtained in the same manner as in Example 10 by adding 5 g of hydroxyethyl methacrylate and 95 g of n-butyl methacrylate to 500 cc of butyl acetate.

0.2 g of the azo compound used in Example 9 and 0.15 g of the above polymer were added to a mixed solvent comprising 5 cc of methyl ethyl ketone and 15 cc of 1,2-dimethoxyethane and the resulting dispersion was coated on an aluminum foil and dried to form a carrier generation layer. Furthermore, a carrier transport layer was formed in the same manner as in Example 10 to obtain a photoreceptor. Results of measurement are shown in Table 5.

COMPARATIVE EXAMPLE 15

0.2 g of the azo compound used in Example 9 and 0.15 g of phenoxy resin (RKHJ) were added to a mixed solvent comprising 5 cc of methyl ethyl ketone and 15 cc of 1,2-dimethoxyethane to prepare a dispersion. The dispersion was coated on an aluminum foil and dried to form a carrier generation layer. Thereafter, a photoreceptor was produced in the same manner as in Comparative Example 14. Results of measurement are shown in Table 5.

TABLE 5

| | Change in initial potential and residual potential due to repetition of 10000 times | |
|---|---|---|
| | Change in initial potential [V] | Change in residual potential [V] |
| Example 8 | −30 | +25 |
| Comparative Example 8 | −120 | +22 |
| Comparative Example 9 | −95 | +35 |
| Comparative Example 10 | −65 | +40 |
| Comparative Example 11 | −155 | +20 |
| Example 9 | −35 | +42 |
| Comparative Example 12 | −60 | +58 |
| Comparative Example 13 | −98 | +52 |
| Example 10 | −42 | +38 |
| Comparative Example 14 | −75 | +45 |
| Comparative Example 15 | −110 | +35 |

As explained above, the electrophotographic photoreceptor of the present invention is excellent in pre-exposure properties and durability for repeated use.

We claim:

1. An electrophotographic photoreceptor comprising:

a conductive support;

a carrier generation layer containing a carrier generation material which generates a carrier upon absorption of light, the carrier generation layer being provided on the conductive support; and a carrier transport layer containing a carrier transport material which transports the generated carrier, the carrier transport layer being provided on the carrier generation layer, wherein the carrier generation layer contains at least one compound selected from the compounds represented by the following formula [I-A], [I-B], [I-18] and [I-21]:

[I-A]

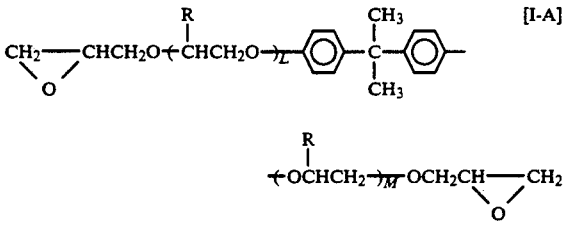

wherein R represents a hydrogen atom or an alkyl group of 1–4 carbon atoms and L and M each represents an integer of 1–4;

[I-B]

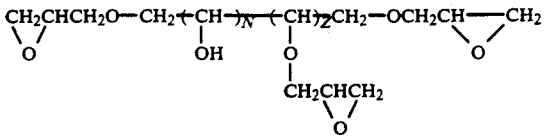

wherein N+Z represents an integer of 1–4;

[I-18]

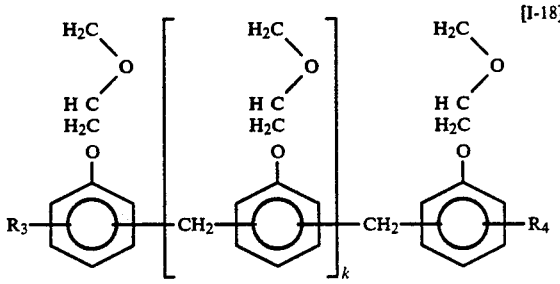

wherein k represents an integer of 0–15 and $R_3$ and $R_4$ each represent a hydrogen atom or an alkyl group of 1–4 carbon atoms.

[I-21]

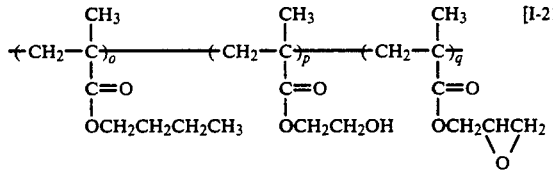

wherein o, p and q represent a constitutional ratio and o+p+q=1 and q is a number greater than 0.1 and less than or equal to 0.9, and o and p are 0.05 or more respectively.

2. A photoreceptor according to claim 1, wherein the carrier generation layer contains at least one compound selected from those represented by the formulas [I-A] and [I-B].

3. A photoreceptor according to claim 1, wherein the carrier generation layer contains other binder resin in an amount of 1–1000 parts by weight per 100 parts by weight of the carrier generation material together with the compound.

4. A photoreceptor according to claim 3, wherein the carrier generation layer contains other binder resin in an amount of 10–200 parts by weight per 100 parts by weight of the carrier generation material together with the compound.

5. A photoreceptor according to claim 1, wherein the carrier generation layer contains the compound in an amount of 0.1–1000 parts by weight per 100 parts by weight of the carrier generation material.

6. A photoreceptor according to claim 1, wherein the carrier generation layer contains the compound in an amount of 1–400 parts by weight per 100 parts by weight of the carrier generation material.

7. A photoreceptor according to claim 1, wherein the thickness of the carrier generation layer is 0.1–2 μm.

* * * * *